US010607754B2

(12) United States Patent
Durth et al.

(10) Patent No.: US 10,607,754 B2
(45) Date of Patent: Mar. 31, 2020

(54) OVERVOLTAGE PROTECTION DEVICE WITH VARISTORS

(71) Applicant: PHOENIX CONTACT GMBH & CO KG, Blomberg (DE)

(72) Inventors: Rainer Durth, Horn-Bad Meinberg (DE); Jan-Erik Schmutz, Detmold (DE); Maik Dittert, Bad Salzuflen (DE)

(73) Assignee: PHOENIX CONTACT GMBH & CO KG (DE)

( * ) Notice: Subject to any disclaimer, the term of this patent is extended or adjusted under 35 U.S.C. 154(b) by 0 days.

(21) Appl. No.: 16/104,023

(22) Filed: Aug. 16, 2018

(65) Prior Publication Data

US 2019/0057798 A1 Feb. 21, 2019

(30) Foreign Application Priority Data

Aug. 18, 2017 (DE) ..... 10 2017 214 402

(51) Int. Cl.

| | |
|---|---|
| ***H01C 7/12*** | (2006.01) |
| ***H01C 1/02*** | (2006.01) |
| ***H01C 1/084*** | (2006.01) |
| ***H01C 1/14*** | (2006.01) |
| ***H01C 13/02*** | (2006.01) |

(52) U.S. Cl.

CPC ..... *H01C 7/12* (2013.01); *H01C 1/02* (2013.01); *H01C 1/084* (2013.01); *H01C 1/14* (2013.01); *H01C 7/123* (2013.01); *H01C 13/02* (2013.01)

(58) Field of Classification Search

CPC ..... H01C 7/12; H01C 1/084; H01C 7/123; H01C 13/02

See application file for complete search history.

(56) References Cited

U.S. PATENT DOCUMENTS 4,365,282 A * 12/1982 Brainard ..... H01C 7/12 338/21
5,130,884 A * 7/1992 Allina ..... H01R 13/6666 361/117
5,375,030 A * 12/1994 Simpson ..... H01C 7/12 361/111

(Continued)

FOREIGN PATENT DOCUMENTS

CN 102456996 5/2012
DE 102006007404 6/2007

(Continued)

OTHER PUBLICATIONS

JP 06-311643, Takaoka Electric. Machine translation of Description. (Year: 1994).*

(Continued)

*Primary Examiner* — Kyung S Lee
(74) *Attorney, Agent, or Firm* — Sheridan Ross P.C.

(57) ABSTRACT

The invention relates to an overvoltage protection device with varistors, wherein a first varistor and a second varistor are connected in series, wherein the first varistor has a thermal disconnector, wherein the first varistor has a lower operating voltage than the second varistor, and wherein the first varistor has a lower energy absorption capacity than the second varistor, with the first varistor heating up more in the event of an overload and thereby causing the thermal disconnector to disconnect.

13 Claims, 3 Drawing Sheets

(56) References Cited

U.S. PATENT DOCUMENTS

| | | | | |
|---|---|---|---|---|
| 5,635,436 | A * | 6/1997 | Fukuda | H01C 7/115 501/138 |
| 6,342,828 | B1 * | 1/2002 | Hagemeister | H01C 7/108 29/610.1 |
| 10,128,028 | B2 * | 11/2018 | Hsu | H01C 1/144 |
| 2007/0025044 | A1 * | 2/2007 | Golubovic | H01C 7/102 361/124 |
| 2007/0217111 | A1 | 9/2007 | Tseng | |
| 2007/0217112 | A1 * | 9/2007 | Lagnoux | H01C 7/12 361/118 |
| 2008/0088405 | A1 * | 4/2008 | Xu | H01C 7/10 338/21 |
| 2009/0009921 | A1 * | 1/2009 | Wosgien | H01C 7/12 361/127 |
| 2015/0294769 | A1 * | 10/2015 | Liu | C04B 35/453 338/21 |

FOREIGN PATENT DOCUMENTS

| | | |
|---|---|---|
| EP | 3226261 | 10/2017 |
| JP | H01-200604 | 8/1989 |
| JP | H02-220406 | 9/1990 |

OTHER PUBLICATIONS

JP 03-045559, Shochi et al. Machine translation of Description. (Year: 1991).*

Official Action for German Patent Application No. 102017214402.5, dated Apr. 16, 2018, 5 pages.

* cited by examiner

OVERVOLTAGE PROTECTION DEVICE WITH VARISTORS

CROSS-REFERENCE TO RELATED APPLICATIONS

This application claims the benefit of German Patent Application No. DE 102017214402.5 filed Aug. 18, 2017, the entire contents of which are incorporated herein by reference.

BACKGROUND

It is known to use a varistor as overvoltage protection element. The varistor is connected to the supply voltage in parallel with a device to be protected. If an overvoltage event occurs, the varistor becomes conductive and conducts the overvoltage past the device to be protected.

However, varistors are subject to aging processes. One aging process results from a large number of discharges, and another aging process occurs as a result of the strength and duration of a discharge process. Thermal processes play a special role here. The two abovementioned aging processes occur at different speeds. In particular, in the latter aging process, there is a risk of breakdown, i.e., of a short circuit-like connection occurring, that can result in the explosion-like destruction of the varistor due to the high energy conversion. This explosive destruction can lead to fires in addition to the explosion effect.

Disconnectors are therefore usually provided in order to protect varistors from thermal overload. These disconnectors are usually based on a mechanically biased connector that is connected with a solder to the varistor. If the varistor heats up excessively, the solder softens and the biased connector moves away, disconnecting the electrical connection.

However, it is often found that, in the event of high energy conversions, separation is no longer possible with conventional disconnectors.

However, it would be desirable to provide an overvoltage protection device that safely disconnects even in the case of high energy conversions.

OBJECT

Given this situation, it is the object of the invention to provide an improved overvoltage protection device that makes it possible to provide a quick-responding and reasonably priced disconnection of high pulse events.

BRIEF DESCRIPTION OF THE INVENTION

The object is achieved by an overvoltage protection device according to claim 1. Additional advantageous embodiments particularly constitute the subject matter of the dependent claims, figures, and the detailed description.

BRIEF DESCRIPTION OF THE FIGURES

The invention will be explained in greater detail below with reference to the figures. In the figures.

DETAILED DESCRIPTION OF THE INVENTION

Figure 1:
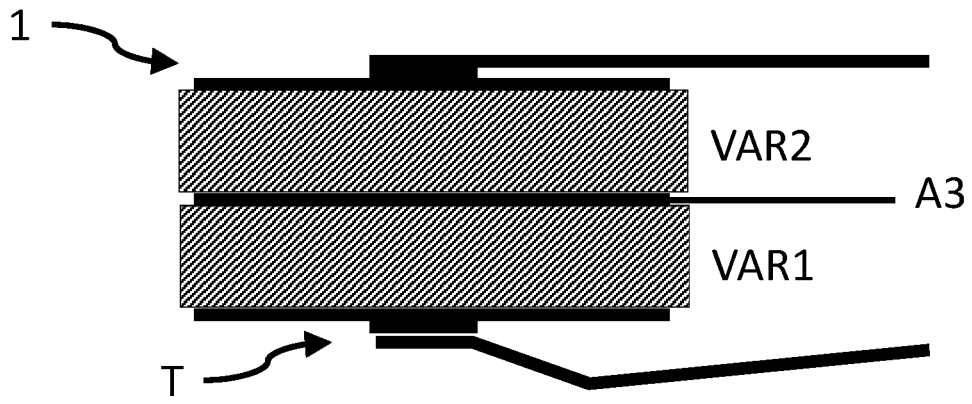
FIG. 1 shows a sectional view according to first embodiments of the invention.

In the following, the invention will be explained in greater detail with reference to the figures. It should be noted that different aspects are described, each of which can be used individually or in combination.

That is, any aspect may be used with different embodiments of the invention unless explicitly portrayed as a mere alternative.

Furthermore, reference will be generally made to only one entity in the following for the sake of simplicity. Unless explicitly stated, however, the invention can also have several of the entities concerned. As such, the use of the words "a" and "an" is to be understood merely as an indication that, in a simple embodiment, at least one entity is used without precluding the use of multiple entities.

The overvoltage protection device 1 according to the invention has at least two varistors. In the following, two varistors VAR1, VAR2 will be assumed.

The first varistor VAR1 and the second varistor VAR2 are connected in series, with the first varistor VAR1 having a thermal disconnector T.

The first varistor VAR1 has a lower operating voltage than the second varistor VAR2. The first varistor VAR1 also has a lower energy absorption capacity than the second varistor VAR2.

In the event of an overload, the first varistor VAR1 will therefore heat up more than the second varistor VAR2. As a result, the thermal disconnector T is caused to disconnect.

That is, unlike in previous overvoltage protection devices, a combination of differently powerful varistors VAR1, VAR2 is used, with the less powerful varistor VAR1 being connected to the thermal disconnector T. The two "sub-varistors" of the series circuit are dimensioned in terms of their capacity or energy absorption capacity such that, when the less powerful varistor VAR1 fuses, the more powerful varistor VAR2 has not yet fused.

The two varistors VAR1, VAR2 are preferably selected with regard to their operating/nominal/rated voltages such that the fusing of the less powerful varistor VAR1 under corresponding mains voltage conditions only results in a moderate increase in the current through the series circuit.

This means that the more powerful varistor VAR2 must achieve the majority of the entire varistor rated voltage of the overvoltage protection device and the less powerful varistor VAR1 a much smaller portion of the overall varistor rated voltage of the overvoltage protection device.

Especially preferably, the voltage distribution is such that the less powerful varistor VAR1 is less than or equal to 25% of the total rated voltage of the overvoltage protection device.

Such an arrangement of varistors of different capacities can be realized in various ways.

The realization and coordination of the different varistor capacities can be achieved in different ways.

It should first be noted that the capacity of a varistor having a certain type of ceramic can be achieved by varying the geometric arrangement. That is, the smaller the surface area of the varistor ceramic, the lower the capacity. On the other hand, it is also possible to achieve different capacities with different ceramic types using the same geometric arrangement. Yet another possibility is the provision of a heat sink, so that, for example, a varistor with more pronounced cooling has a higher capacity than a similar varistor with no or less pronounced cooling.

For example, FIG. 1 shows the basic arrangement of varistors in an overvoltage protection device 1, in which the geometric dimensions of the varistors VAR1, VAR2 are substantially equal. The energy and voltage of the varistors VAR1, VAR2 are coordinated, for example, through the use of different ceramic types, such as E7 or type 2 ceramics, for example.

Figure 2:
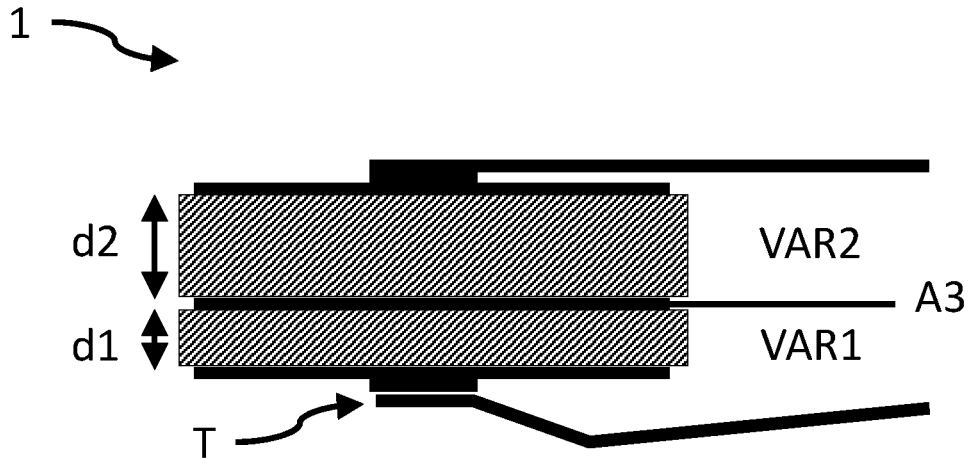
FIG. 2 shows an additional sectional view according to second embodiments of the invention.

FIG. 2 shows another basic arrangement of varistors in an overvoltage protection device 1 in which the surface areas of the varistors VAR1, VAR2 are substantially equal.

The coordination of the energy and/or voltage between the varistors VAR1, VAR2 is achieved inter alia by varying the thickness of the varistor ceramic. That is, the first varistor VAR1 has a first ceramic layer thickness d1, and the second varistor VAR2 has a second ceramic layer thickness d2 that differs therefrom.

Figure 3:
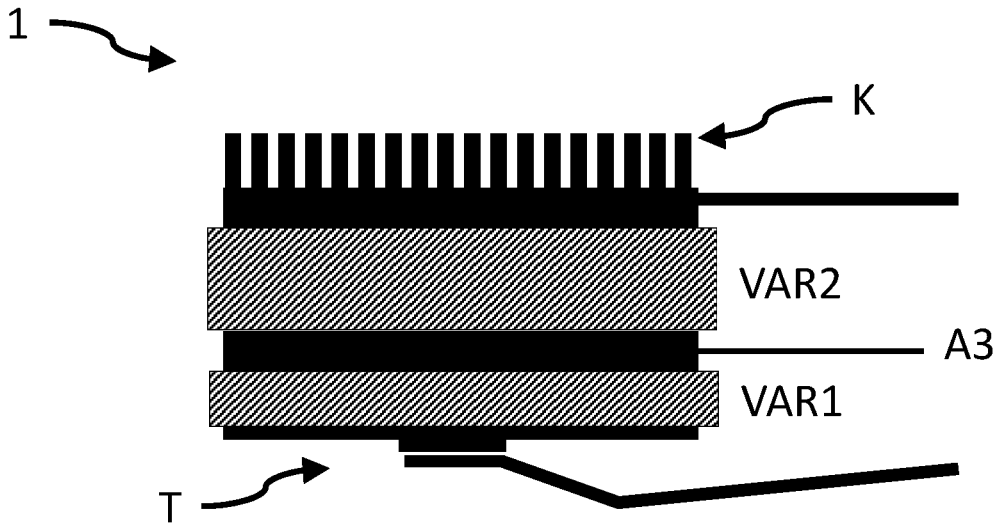
FIG. 3 shows an additional sectional view according to third embodiments of the invention.

FIG. 3 shows another basic arrangement of varistors in an overvoltage protection device 1 in which the surface areas of the varistors VAR1, VAR2 are substantially equal. The energetic coordination between the varistors VAR1, VAR2 is achieved by varying the cooling and/or by varying the thermal coupling of cooling masses with the ceramics. In the example of FIG. 3, a cooling device K—such as a heat sink, for example—is associated with the second varistor.

Figure 4:
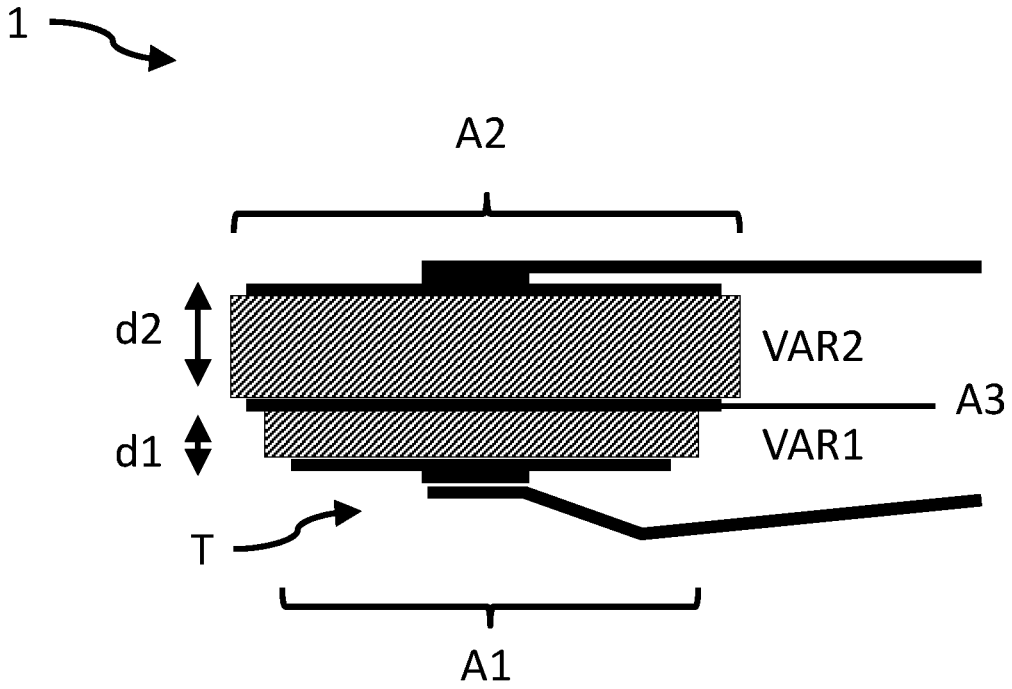
FIG. 4 shows an additional sectional view according to fourth embodiments of the invention.

FIG. 4 shows another basic arrangement of varistors in an overvoltage protection device 1 in which the surface areas of the varistors VAR1, VAR2 are substantially unequal. Here, the less powerful varistor VAR1 has a smaller thickness d1 and a smaller surface area A1 compared to the more powerful varistor VAR2 having a thickness d2 and a surface area A2. The reduced surface area A1<A2 has the effect that the less powerful varistor VAR1 has a lower capacity even when the capacity of the ceramic material is the same (and even if the thickness of the ceramic is d1=d2).

Figure 5:
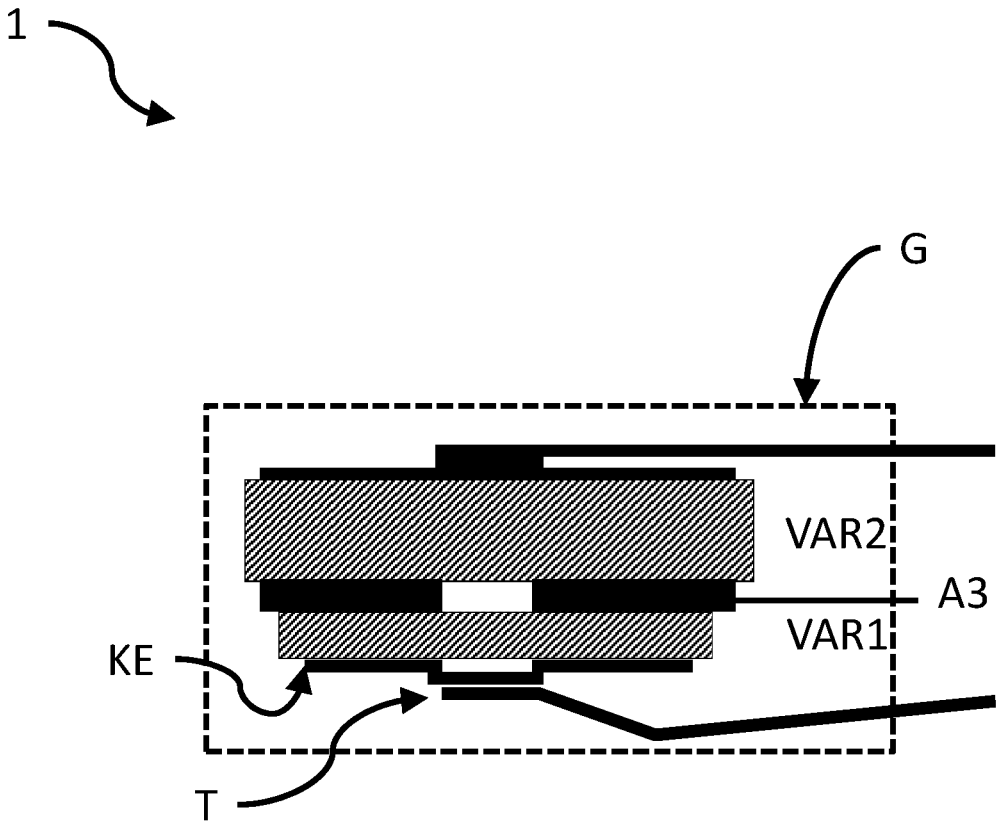
FIG. 5 shows an additional sectional view according to fifth embodiments of the invention.

FIG. 5 shows another basic arrangement of varistors in an overvoltage protection device 1 in which the connection of the disconnector T has peculiarities. Here, the varistor VAR1 has a first contact element KE, with the first contact element KE having at least one recess in the region of the thermal disconnector T. As a result, the recessed area of the ceramic has a poorer electrical and thermal connection, since no direct contact exists, so that the corresponding ceramic volume located below it is heated to a greater extent (or cools down more slowly)—meaning that an area for a hotspot is deliberately formed. On the one hand, this improves the triggering of the thermal disconnector T, and on the other hand it can be expected that the less powerful varistor VAR1 will break down precisely in this area, so that the energy converted in the process additionally accelerates the disconnection.

The "recessed" area can be covered mechanically on both sides, so that plasma and pressure cannot penetrate directly to the outside when the less powerful varistor VAR1 fuses.

Special advantages can also be achieved in the exemplary embodiments if the varistors are implemented in a mechanically coupled system, e.g., double or multiple varistor discs. Here, a mechanical stabilization of the arrangement of the varistors can be provided, which is advantageous particularly in the event of an overloading of the lower-power varistor VAR1.

In all embodiments, a tap A3 can also be provided between the varistors VAR1, VAR2 of the series circuit. A change in the voltage divider formed by the varistors VAR1 and VAR2 can then be evaluated, for example, in order to detect a malfunction or detect the function. An inference can also be made regarding the first and the second varistor VAR1, VAR2 on the basis of the different voltages.

The overvoltage protection device 1 can easily further comprise a housing G.

Furthermore, the overvoltage protection device 1 can have a telecommunications interface (not shown), or the tap A3 can be used as a telecommunications interface.

LIST OF REFERENCE SYMBOLS

1 overvoltage protection device
VAR1, VAR2 varistor
T thermal disconnector
d1, d2 ceramic layer thickness
K cooling device
A1, A2 ceramic layer surface area
KE contact element
G housing

The invention claimed is:

1. An overvoltage protection device with varistors, wherein a first varistor and a second varistor are connected in series, wherein the first varistor has a thermal disconnector, wherein the first varistor has a lower operating voltage than the second varistor, and wherein the first varistor has a lower energy absorption capacity than the second varistor, with the first varistor heating up more in the event of an overload and thereby causing the thermal disconnector to disconnect.

2. The overvoltage protection device as set forth in claim 1, wherein the operating voltage of the first varistor is less than or equal to ¼ of the operating voltage of the second varistor.

3. The overvoltage protection device as set forth in claim 1, wherein the first varistor has a first type of ceramic, and wherein the second varistor has a type of ceramic that differs therefrom.

4. The overvoltage protection device as set forth in claim 1, wherein the first varistor has a first ceramic layer thickness, and wherein the second varistor has a second ceramic layer thickness that differs therefrom.

5. The overvoltage protection device as set forth in claim 1, wherein the second varistor is associated with a cooling device.

6. The overvoltage protection device as set forth in claim 1, wherein the first varistor has a first ceramic layer surface area, and wherein the second varistor has a second ceramic layer surface area that differs therefrom.

7. The overvoltage protection device as set forth in claim 1, wherein the first varistor has a first contact element in the vicinity of the thermal disconnector, with the first contact element being embodied such that, in a region below a separation point, the first contact element has no direct electrical contact with the first varistor.

8. The overvoltage protection device as set forth in claim 1, wherein a tap is provided between the first varistor and the second varistor.

9. The overvoltage protection device as set forth in claim 1, further comprising a housing.

10. The overvoltage protection device as set forth in claim 1, further comprising a telecommunications interface.

11. An overvoltage protection device with varistors, wherein a first varistor and a second varistor are connected in series, wherein the first varistor has a thermal disconnector, wherein the first varistor has a lower operating voltage than the second varistor, and wherein the first varistor has a lower energy absorption capacity than the second varistor, with the first varistor heating up more in the event of an overload and thereby causing the thermal disconnector to disconnect, wherein the operating voltage of the first varistor is less than or equal to ¼ of the operating voltage of the second varistor, wherein the first varistor has a first type of ceramic, wherein the second varistor has a type of ceramic that differs from the first type of ceramic, wherein the first varistor has a first ceramic layer thickness, wherein the second varistor has a second ceramic layer thickness that differs from the first ceramic layer thickness, wherein the second varistor is associated with a cooling device, wherein the first varistor has a first ceramic layer surface area, wherein the second varistor has a second ceramic layer surface area that differs from the first ceramic layer surface area, wherein the first varistor has a first contact element in the vicinity of the thermal disconnector, with the first contact element being provided such that, in a region below a separation point, the first contact element has no direct electrical contact with the first varistor, wherein a tap is provided between the first varistor and the second varistor, and wherein the overvoltage protection device further comprises a housing.

12. The overvoltage protection device as set forth in claim 11, further comprising a telecommunications interface.

13. The overvoltage protection device as set forth in claim 1, wherein the thermal disconnector disconnects when a temperature of the thermal disconnector exceeds a threshold.

* * * * *